United States Patent [19]

Hughes

[11] Patent Number: 4,993,199

[45] Date of Patent: Feb. 19, 1991

[54] PORTABLE SELF-CONTAINED DECONTAMINATION BOOTH

[75] Inventor: Joel J. Hughes, Wilmington, N.C.

[73] Assignee: Container Products Corporation, Wilmington, N.C.

[21] Appl. No.: 493,773

[22] Filed: Mar. 15, 1990

Related U.S. Application Data

[63] Continuation-in-part of Ser. No. 31,611, Mar. 30, 1987, Pat. No. 4,928,440.

[51] Int. Cl.[5] ..... B24C 3/00

[52] U.S. Cl. ..... 51/426; 51/425; 51/273; 134/200; 134/104.4

[58] Field of Search ..... 51/426, 425, 319-321, 51/417, 427, 273, 424, 419; 134/100, 102, 107, 104.4, 200

[56] References Cited

U.S. PATENT DOCUMENTS

| | | | |
|---|---|---|---|
| 2,576,008 | 11/1951 | Gladfelter et al. | 51/427 |
| 2,678,520 | 5/1954 | Jewett | 51/426 |
| 2,753,668 | 7/1956 | Strnad | 51/273 |
| 3,103,765 | 9/1963 | Nolan | 51/426 |
| 3,160,993 | 12/1964 | McCormick, Jr. | 51/426 |
| 3,300,902 | 1/1967 | Dockery | 51/426 |
| 4,170,240 | 10/1979 | Gentry | 134/104.4 |

FOREIGN PATENT DOCUMENTS

| | | | |
|---|---|---|---|
| 2303055 | 12/1973 | Fed. Rep. of Germany | 51/426 |

*Primary Examiner*—Robert A. Rose

[57] ABSTRACT

A portable self-contained decontamination booth suitable for removing contamination from reusable parts and tools. The front wall of the booth divides a transparent inclined viewing window above sealed work glove ports. An elevated eye-level control panel permits ready access to the controls for operating the booth. The interior of the booth being accessible through pneumatic side doors positioned at a level with portable side work tables which provide housing for the units which super heat the cleaning fluid as well as a self-contained ventilating system including a demister, filter and high capacity blowers.

12 Claims, 3 Drawing Sheets

PORTABLE SELF-CONTAINED DECONTAMINATION BOOTH

CONTINUATION IN PART

This application is a continuation in part of a U.S. patent application Ser. No. 07/031,611, filed Mar. 30, 1987, now U.S. Pat. No. 4,928,440

FIELD OF THE INVENTION

This invention relates to a self-contained portable sealable decontamination booth utilized in heated pressurized liquid cleaning systems. The structure includes a work-like cabinet which provides a transparent viewing window positioned above sealed work glove ports. The interior of the work booth being accessible through side doors that are pneumatically moved through a vertical plane by means exteriorly of the cabinet. The assembly includes associated portable side work tables which provide work supporting surfaces at the level of the access windows and which house the cleaning fluid heater and pressurizer, as well as the vacuum creating air flow mechanism for the work booth, and the recovery and filter system for the contaminated work cleansing fluid whereby such fluid is demisted, separating the moisture from any decontaminated particles.

DESCRIPTION OF THE PRIOR ART

The present invention constitutes an improvement over such analogous apparatuses as disclosed in U.S. Pat. No. 2,576,008, dated Nov. 20, 1951 and issued to Gladfelter, et al; U.S. Pat. No. 3,300,902, dated Jan. 31, 1967, issued to L. B. Dockery; U.S. Pat. No. 3,352,063, dated Nov. 14, 1967, issued to A. H. Eppler; and U.S. Pat. No. 4,300,318, dated Nov. 17, 1981, issued to Donald J. Brown.

None of the prior art discloses a portable self-contained decontamination booth. The earlier booths had to be permanently positioned with respect to a cleaning fluid supply source and a fixed heating and pressurized unit, and provided a recoverable waste which was obtained through a single filter system. Thus these wastes were of a mixed consistency providing problems of proper disposal.

SUMMARY OF THE INVENTION

It is principal object of the present invention to provide a complete decontamination apparatus that is portable and self-contained. The apparatus includes a booth-like cabinet and a pair of side work tables with all of these structures being connected together as a single portable unit. One of the side tables houses a vacuum creating blower which by external communication with the work booth establishes a continuing current of air flow therethrough, creating a negative pressure therein. A recovery system also having communication with the interior of the booth includes a vacuum recovery dual filter arrangement for the spent cleaning fluids utilized in the operation of the apparatus. The side table also contains a fluid heater and pressurizer for the cleaning fluid used in the decontamination operation.

A further object of the invention is to provide an improved access system to the interior of the booth which includes vertically slidable doors that are so arranged so as to be disposed within the collecting base of the booth whereby no contaminated debris or moisture that may collect thereon will escape into the ambient atmosphere during their opening and closing operation.

Other objects will appear and be made apparent hereinafter.

BRIEF DESCRIPTION OF THE DRAWINGS

The invention will be best understood by reference to the accompanying drawings which illustrate the preferred construction and arrangement of parts by which the objects of this invention are achieved and in which:

FIG. 3 is a rear elevational view of the work booth of this invention,

DESCRIPTION OF THE PREFERRED EMBODIMENT

Figure 1:
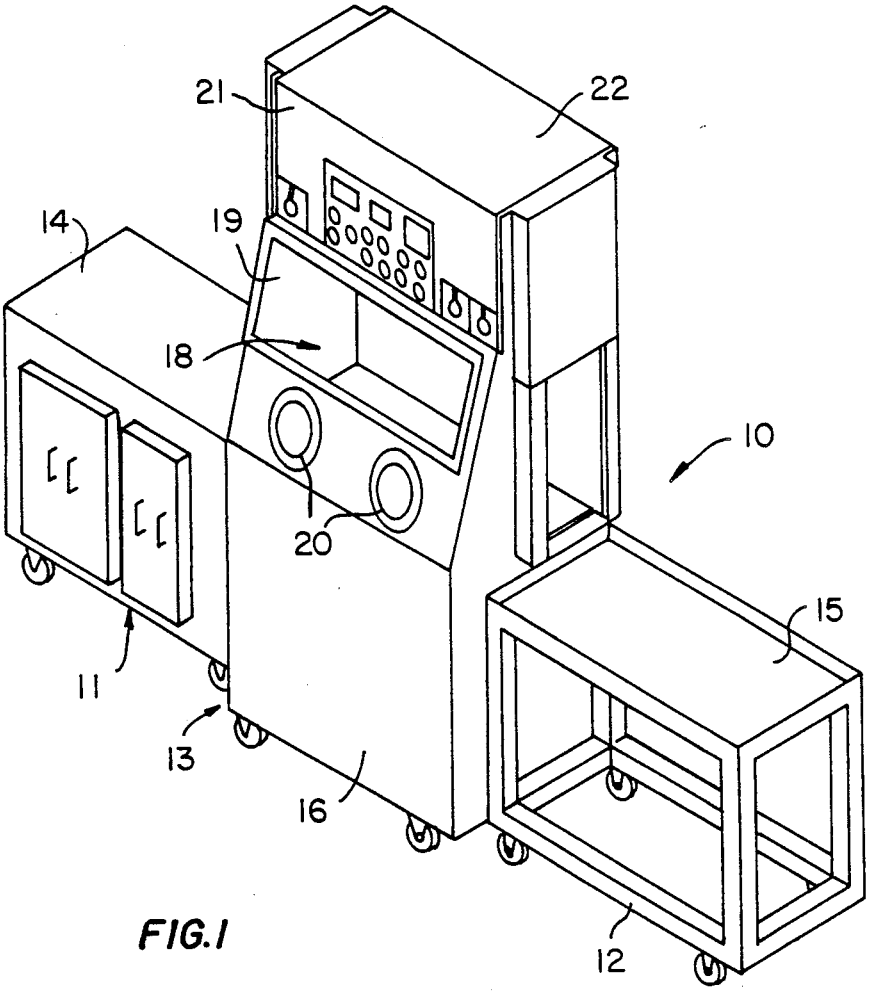
FIG. 1 is a perspective view of this invention.

The portable self-contained decontamination booth illustrated in FIG. 1 includes portable side tables 10 and 11 removably attached by clamp-like members (not shown) to either side of the booth 12.

Each side table 10 and 11 provides a work surface 13 which is in horizontal alignment with the bottom edge of the access side doors. The table 10 provides a cabinet-like base 14 accessible through front hinged doors 15.

The booth 12 includes a hollow base 16 the top of which is defined by a suitable grate-like work surface 17 which is generally in the horizontal plane of the work surfaces 13 of the side tables 10 and 11.

Above the base 16 is a work station 18 defined by an inclined wall 19 that in turn contains glove ports 20 as well as a viewing window 21. The top structure 22 of the booth 12 provides an eye level work control panel 23.

Access to the interior of the work station 18 is through a pair of side doors 24 which are adapted to be pneumatically raised and lowered into an open and closed position.

Referring to FIG. 3 there is shown a pair of air regulator valves 26 as well as a liquid line control valve 27, the latter being in communication with a supply line 28 that in turn has connection through a suitable coupling with a spray gun (not shown) positioned within the work station 18. A quick connector 29 extends through the rear wall and is suitable for attachment to a ventilating system contained within the cabinet-like base 14 of the side table 10. This vacuum system includes a demister, and a hepa filter, as well a high capacity blower. Also within the cabinet-like base 14 of the side table 10 is a super heated liquid supply unit which in turn has suitable quick connection communication with the line control valve 27.

An interior lighting system includes a light fixture 31 positioned in the top structure 22 of the booth 12 such that it will illuminate the work station 18.

Figure 4:
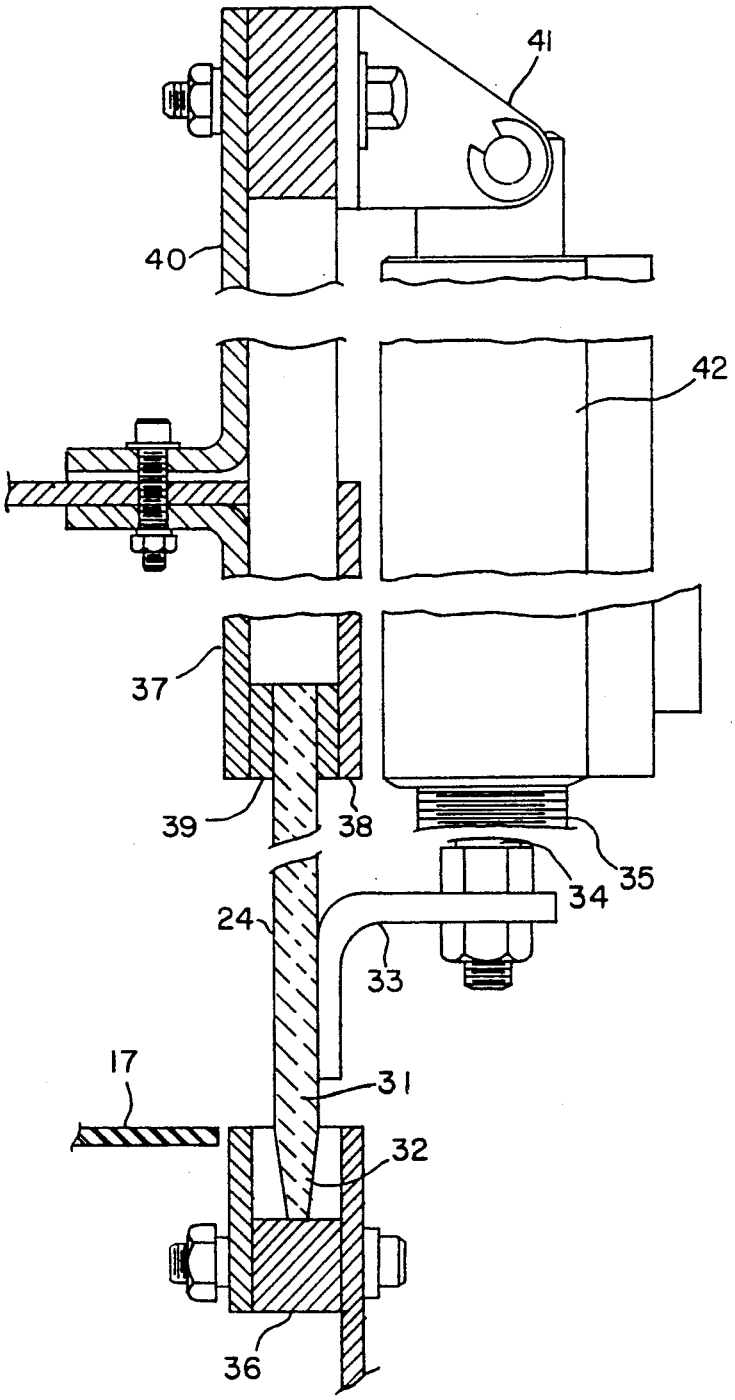
FIG. 4 is a side elevational detailed view of one of the side access doors.

As shown in FIG. 4 one of the side doors 24 has connected thereto adjacent its bottom edge 32 an L-shaped bracket 33. One end 34 of a pneumatic piston 35 is connected to the bracket 33 on the exterior side of the door 24.

A sealing gasket 36 is contained within a recess that extends to one side of the work station grating 17 with the recess adapted to receive the tapered bottom edge 32 of the side door 24 when it is in its closed position and in contact with the gasket 36. The side walls defining the access door opening are also provided with like gaskets so as to completely seal the interior of the booth 12. It should be noted both side doors 24 are of like construction and have like movable means.

Mounted on the top wall of the work station is a door gasket retaining bracket 37 which together with a frame structural member 38 of the booth 12, supports an upper sealing gasket 39 for the side door 24. A raised cowling 40 supported by the top wall for the work station provides a base for the pivotal mount 41 of a pneumatic cylinder 42 which may be enclosed within a closed cowling 43 (see FIG. 1).

By this arrangement when the pneumatic cylinder 42 is actuated its movable piston 35 will raise or lower the door 24 so as to provide access to the work station 18 or to seal the same during a cleaning and decontaminating operation.

Figure 5:
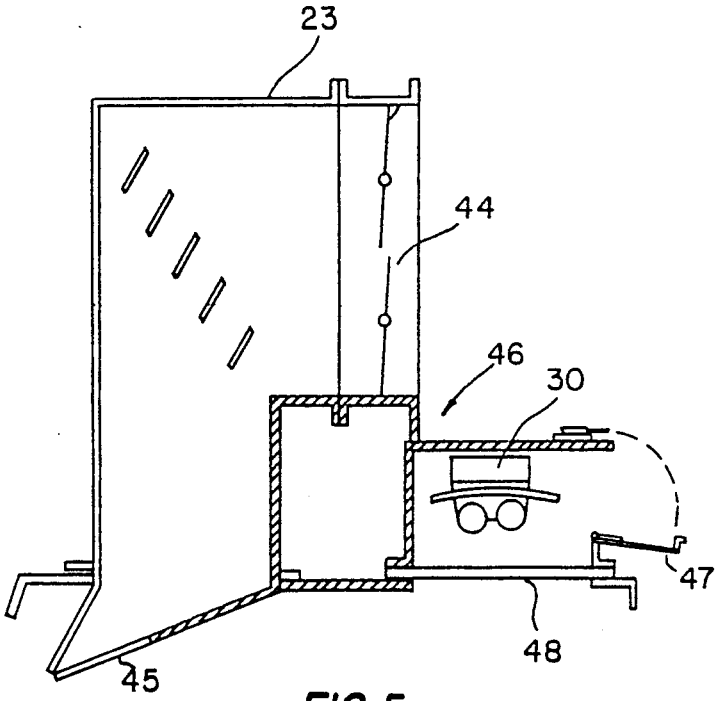
FIG. 5 is a side elevational sectional view of the air intake plenum of this invention.
Figure 2:
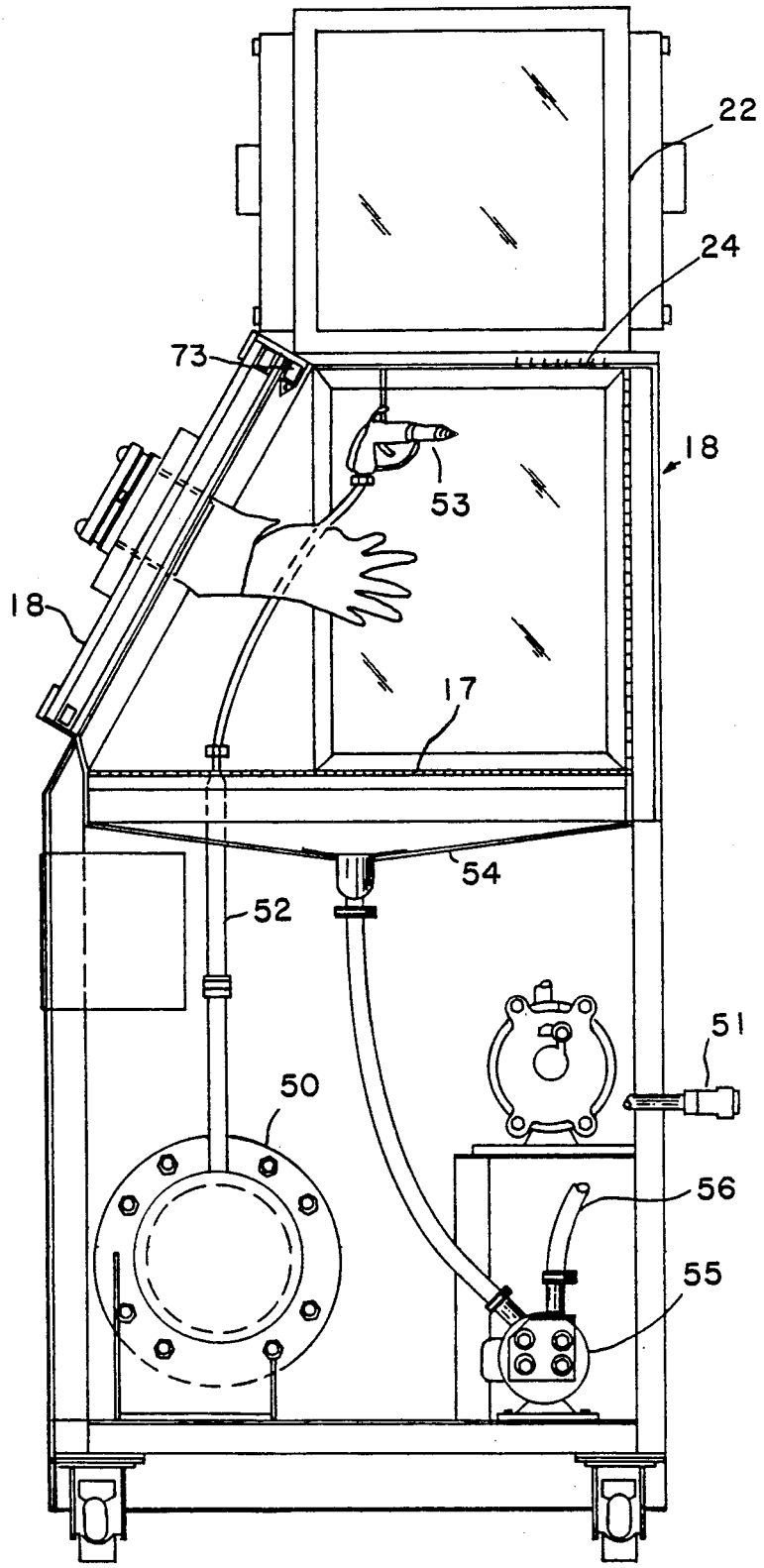
FIG. 2 is a side elevational view of the structure of FIG. 1.

In FIG. 5 there is shown the arrangement for an air intake plenum 23. As such plenum 23 includes a back draft damper 44 which prevents reverse exhaust movement of any air from within the booth 12. A directional vent 45 is provided being strategically mounted so as to direct air flow directly over the transparent viewing window 21.

Mounted on the rear of the plenum 23 is a light assembly 46. This light assembly 46 includes an access door 47 to a double light fixture 30 which is positioned above a transparent lens 48.

As noted in FIG. 1 the front incline wall 19 is provided with a manually operated sealed access door 50. After a decontamination operation a suitable instrument may be projected through this access door 50 into the interior of the cabinet to ascertain the presence of any excess objectionable conditions such as radiation or the like.

From the foregoing it is apparent that there has been described a decontamination booth which is completely atmospherically sealed by creating a negative atmosphere within the booth during its use in decontaminating items requiring such cleansing.

The booth has been described as providing pneumatically operated side access doors which are entirely confined within the interior area of the booth so that when they are raised into an open position, and with the vacuum system in operation, any decontamination, or moisture laden particles that have collected thereon during the cleansing operation will be drawn into the cabinet and prevented from exiting into the ambient atmosphere.

All of the above is contained in the portable self-supporting units which have heretofore been fully described.

While there has been illustrated and described the preferred form of construction for carrying this invention into effect, this is capable of variation and modification without departing from the spirit of the invention. Therefore there is no wish to be limited to the precise details of construction as set forth, thus making available variations and modifications that may come within the scope of the appended claims.

Having thus described the invention what is claimed and desired to be protected by Letters Patent is:

1. A portable self-contained decontamination booth including an atmospherically sealed cabinet having a source of vacuum connected thereto for creating a negative pressure within the cabinet, as well as a cleaning fluid application gun within the work area of the cabinet comprising:

(a) a portable booth assembly including a cabinet and associated side work tables, (b) a work area within said cabinet including a work piece supporting grating disposed in horizontal alignment with the top surfaces of said side work tables, (c) said cabinet including an inclined viewing window for said work area and work glove ports, and an eye-level vertical control panel, (d) a pair of access side doors for said work area including pneumatic cylinders positioned exteriorly of said cabinet and having their movable pistons operatively connected to the outside of said doors for moving the same through a vertical plane into an open or closed position, (e) an exhaust system carried by one of said work tables and providing communication with said work area of said cabinet for creating a source of vacuum therein and a negative pressure throughout the cabinet, and (f) a dual filter assembly carried by said one of said work tables and providing communication with said work area of said cabinet for recovering the waste laden exhaust of said cabinet.

2. A portable self-contained decontamination booth as defined by claim 1 wherein said dual filter assembly comprises a demister and a hepa filter connected in tandem in said exhaust system for recovering the waste laden exhaust.

3. A portable self-contained decontamination booth as defined by claim 1 including means for sealing said pair of access side doors against the ambient atmosphere and for maintaining a negative pressure within the cabinet.

4. A portable self-contained decontamination booth as defined by claim 3 wherein said dual filter assembly comprises a demister and a hepa filter connected in tandem in said exhaust system for recovering the waste laden exhaust.

5. A portable self-contained decontamination booth as defined by claim 1 including means for illuminating said work area within said cabinet.

6. A portable self-contained decontamination booth as defined by claim 1 including a heating and pressurizing system within said one of said work tables for supplying said cabinet with a heated pressurized cleaning fluid.

7. A portable self-contained decontamination booth as defined by claim 6 wherein said dual filter assembly comprises a demister and a hepa filter connected in tandem in said exhaust system for recovering the waste laden exhaust.

8. A portable self-contained decontamination booth as defined by claim 6 including means for sealing said pair of access side doors against the ambient atmosphere and for maintaining a negative pressure within the cabinet.

9. A portable self-contained decontamination booth as defined by claim 1 including a manually operable sealed instrument door formed in said cabinet adjacent said inclined viewing window through which a measuring instrument is insertable within said sealed work area.

10. A portable self-contained decontamination booth as defined by claim 9 including means for sealing said pair of access side doors against the ambient atmosphere and for maintaining a negative pressure within the cabinet.

11. A portable self-contained decontamination booth as defined by claim 9 wherein said dual filter assembly comprises a demister and a hepa filter connected in tandem in said exhaust system for recovering the waste laden exhaust.

12. A portable self-contained decontamination booth as defined by claim 9 including a heating and pressurizing system within said one of said work tables for supplying said cabinet with a heated pressurized cleaning fluid.

* * * * *